US006146274A

United States Patent [19]

Salour et al.

[11] Patent Number: 6,146,274

[45] Date of Patent: Nov. 14, 2000

[54] CABINET AND HOPPER COMBINATION FOR GAMING MACHINES INCLUDING A CONTROLLER AND MONITOR FOR OPENING AND CLOSING THEREOF

[75] Inventors: David D. Salour; James R. Woodhams; John R. Martinez, all of Las Vegas, Nev.

[73] Assignee: Aurora Gaming, Las Vegas, Nev.

[21] Appl. No.: 09/260,397

[22] Filed: Mar. 1, 1999

Related U.S. Application Data

[63] Continuation-in-part of application No. 08/975,786, Nov. 21, 1997, Pat. No. 5,876,285.

[51] Int. Cl.[7] ..... G07F 1/04

[52] U.S. Cl. ..... 463/29; 194/350

[58] Field of Search ..... 273/143 R, 148 R; 463/29, 25, 20, 46; 194/350, 215; 235/381

[56] References Cited

U.S. PATENT DOCUMENTS

| | | | |
|---|---|---|---|
| 4,836,352 | 6/1989 | Tateno et al. | 194/215 |
| 5,579,888 | 12/1996 | Slyper | 194/350 |
| 5,955,718 | 9/1999 | Levasseur et al. | 235/281 |

*Primary Examiner*—Benjamin H. Layno
*Attorney, Agent, or Firm*—Quirk & Tratos

[57] ABSTRACT

A cabinet and hopper combination is set forth for slot machines which includes a cabinet structure having an opening for coins to drop from the machine into the hopper. The hopper is removably mounted in the cabinet and has a door slidable between a closed and an open position. A handle at the outside of the cabinet operates a linkage coupled to the door to open the hopper to dispense coins or tokens therein through the front of the cabinet. Also included are controls to lock the handle against unauthorized dispensing of coins or tokens.

16 Claims, 7 Drawing Sheets

220
220
NO
YES
134
230
228
220
224
232
238
234
210
212
236
ERROR
240
UNLOCKED
LOCK
242
246
244
210
212

CABINET AND HOPPER COMBINATION FOR GAMING MACHINES INCLUDING A CONTROLLER AND MONITOR FOR OPENING AND CLOSING THEREOF

CROSS REFERENCE TO RELATED APPLICATION

This application is a continuation-in-part application of commonly owned application Ser. No. 08/975,786 filed Nov. 21, 1997, now U.S. Pat. No. 5,876,285 and entitled "Cabinet and Hopper Combination For Gaming Machines".

FIELD OF THE INVENTION

The present invention relates to cabinets and hoppers for gaming machines such as slot machines and controllers and monitors for opening and closing thereof.

BACKGROUND OF THE INVENTION

It is known to provide a stand for gaming machines such as slot machines, video poker machines and the like to support the machine at a position convenient for play by a player. Often these machines are placed side by side on one or more stands to define a bank of machines.

In relation to known gaming machines, these machines are adapted to receive wagers in the form of coins or tokens. When the wager of the coin or token is inserted, the coin passes a coin tester which verifies the authenticity of the wager and is directed to a machine hopper contained within the gaming machine housing. When a payout is made by the machine or the player cashes out, coins or tokens are dispensed from the machine hopper.

Because the reservoir defined by the machine hopper is limited due to the size of the machine and the need to include electronic and mechanical components in the housing, it is known to provide a machine hopper overflow bucket in the stand below the machine. When the machine hopper is full, additional wagered tokens or coins are directed through a hole in the bottom of the machine and to the bucket in the stand. At scheduled intervals personnel remove the buckets from the stands below the machines for weighing and counting of the coins.

Because the buckets may be heavy, injury to personnel sometimes occurs as a result of the bending, kneeling and pulling necessary to remove the bucket from the stand. It would be useful to devise a system which would not require personnel to bend, stoop, reach and pull to unload hopper overflow. Further in this regard, it would be useful to remotely know and monitor when overflow is being removed and to prevent unauthorized unloading of the overflow. Still further, it would be advantageous to provide a system which can provide for the emptying of several stands such as in a bank of slot machines and which provides a means to secure the stands from unauthorized access to buckets or hoppers contained therein.

SUMMARY OF THE INVENTION

There is, therefore, set forth according to the present invention a system for locking and unlocking an actuator for discharging coins from a hopper contained in a cabinet which includes a handle and a linkage coupled between the handle and a door for the hopper, the linkage adapted to, in response to movement of said handle between a first and second position, open and close the door for discharging coins from the hopper. Means are provided for locking the handle against movement from the first to the second position including a plate pivotally mounted for rotation about an axis between a locked and an unlocked position. The plate in the locked position engages said handle to prevent movement thereof and thereby prevent the discharge of coins or tokens. A moveable driver member is energized to engage and displace said plate from said locked position to said unlocked position to free the handle for movement to open the door and discharge coins. A controller such as a processor is provided for controlling the energizing of one or more driver members for one or a string of hoppers. Thus the processor can be controlled to, for example, release the handles for opening a plurality of hopper doors such as when a bank of slot machine cabinet hoppers are being emptied.

The controller may be accessed by using a card carrying a code which when read by a card reader energizes the driver(s) to release the handle(s). Alternatively, the controller may include a radio or infrared receiver adapted to receive a coded signal from a transmitter carried by the attendant. When the attendant activates the transmitter a signal is sent which, if the signal contains the acceptable code, causes the controller to energize the driver(s) to release the handle(s). Still further, a data entry device such as a keypad may be provided to send signals to the controller to energize the driver(s).

The processor may be in communication with a central data processing unit to monitor the opening and closing of the hopper doors and log information such as the identity of the attendant emptying the hoppers, date, time of day, location, etc. If a card or transmitter is lost or stolen, the central data processor may be adapted to reset the acceptable codes for the controllers or block the code for the lost card or transmitter.

BRIEF DESCRIPTION OF THE DRAWINGS

These and other features and advantages of the present invention will become better understood with reference to the specification, claims and drawings wherein:

DESCRIPTION

Figure 1:
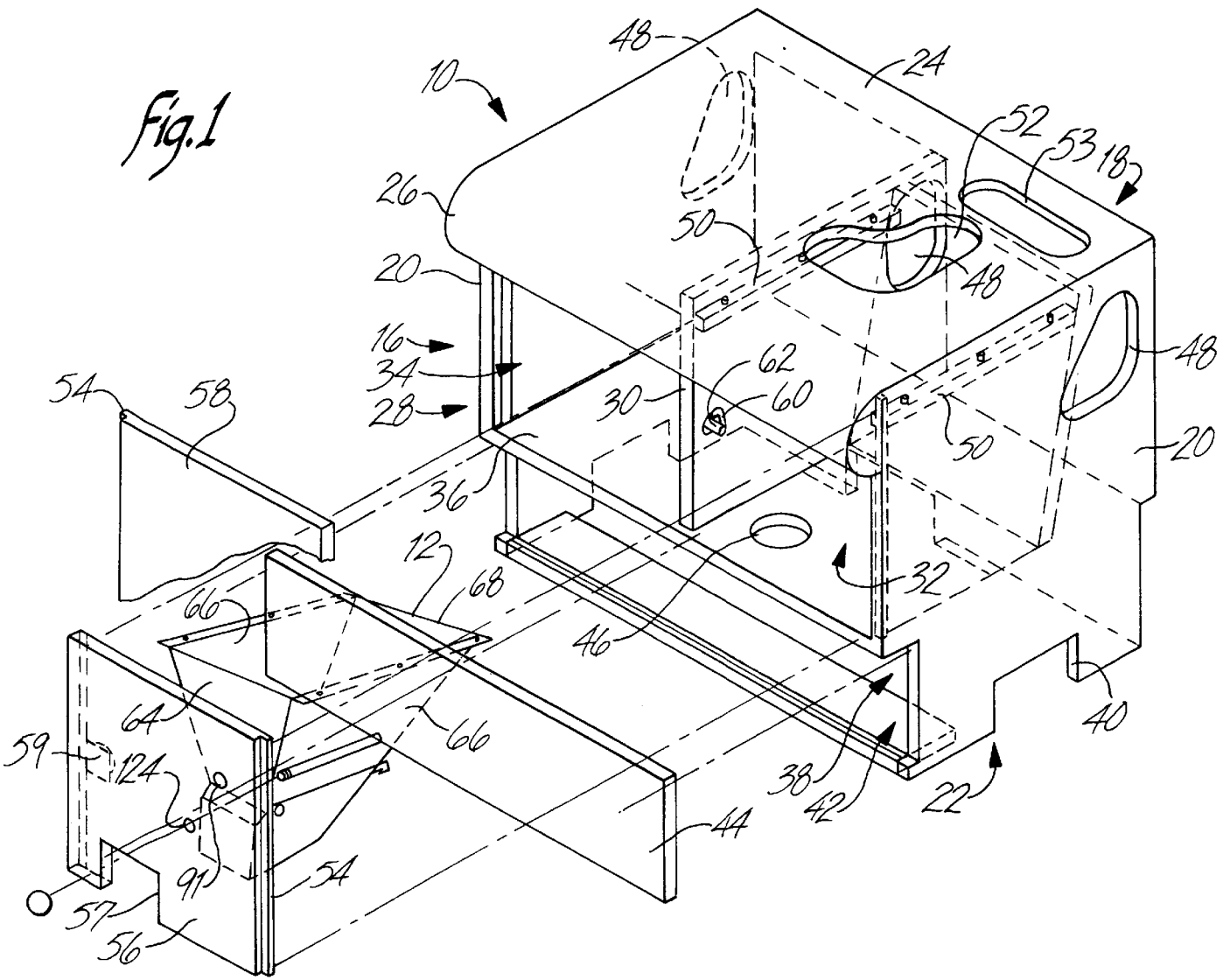
FIG. 1 is a perspective, exploded view of the cabinet and hopper combination of the present invention.

With reference to the drawings, FIG. 1 shows a cabinet 10 and hopper 12 combination according to the present invention. The cabinet 10 is essentially adapted to support a gaming device 14 (FIG. 3) above the floor for play by a player. Accordingly, the cabinet 10 and hopper 12 combination can be placed side by side, back to back, in an oval or round configuration to support a bank of gaming devices 14 in the usual configurations found in casinos.

The cabinet 10 has a front 16, back 18, sides 20, bottom 22, top 24 as well as internal bracing defining a frame structure for the cabinet 10. The flat, rigid top 24 has a width and depth dimension usually slightly greater than the footprint of the gaming device 14 to be placed thereon. At the front 16, the top 24 merges into a bullnose 26 which presents an aesthetic, curved surface at the front of the cabinet 10. Below the top 24 is defined an enclosed receptacle 28 which may have a partition wall 30 to define in the receptacle first and second compartments 32, 34. The bottom of the receptacle 28 and the first and second compartments 32, 34 is defined by a floor 36 which is spaced above the bottom 22 of the cabinet 10. The space between the floor 36 and bottom 22 defines a hollow way 38 for the passage of electrical and data communication conduits through and beneath the cabinet 10. Rectangular cutouts 40 in the sides 20 at the bottom 22 provide access into the way 38. Further access is provided by a large opening 42 at the front 16 of the cabinet 10 which is covered by a removable kick plate 44. The kick plate 44 may be attached to the cabinet 10 by fasteners such as screws, locks or the like. To provide a passageway from the way 38 into the receptacle 28, a bore 46 is located in the floor 36. On the sides 20, proximate the top 24 and back 18 as well as through the partition wall 30 are located openings 48 to provide likewise for the passage of electrical and communication conduits into and through the cabinet 10.

To support the hopper 12 in the manner hereinafter described in the first compartment 32, the cabinet 10 includes a pair of spaced supports 50 disposed within the first compartment 32 along one side 20 and the partition wall 30. Preferably the supports 50 are arranged to be coplanar and parallel and are located equidistant from the top 24.

With continuing reference to FIG. 1, to provide a passageway for coins overflowing from the gaming device 14 into the hopper 12 and, if required, a passage for electrical wires, the cabinet top 24 has a first hole 52, which preferably is kidney-shaped, and an oblong, second hole 53 arranged pass power, electrical and data processing cables between the machine and holes 48 or conduits/cables passing through said holes 48. Gaming machines often differ as to how the coins which overflow from the internally maintained hopper fall from the machine. Accordingly, by providing the kidney-shaped hole 52 and oblong second hole 53, various type of gaming machines can be placed on the cabinet 10 so that overflow coins and electrical wires may pass into the cabinet 10.

To provide a means to close the receptacle 28 and more particularly the first and second compartments 32, 34, the side 20 proximate the front of the first compartment 32 includes a groove adapted to receive a tongue 54 for a first compartment covering first panel 56. Opposite the groove, the inside surface of the first panel 54 has a catch 58. A key lock mechanism 62 on the partition wall 30 is adapted to be operated from inside the first compartment 28 by a key to move a latch 60 to engage the catch 58 to lock the side of the first panel 56 remote from the tongue 54 to the cabinet 10. The key lock 62 operates, in a known fashion, to rotate its catch to capture and release the catch 58 to secure and release the first panel 56 to the cabinet 10. Accordingly, to connect the first panel 56, the user inserts the panel from left to right (FIG. 1) such that the tongue 54 is received into the groove formed in the first compartment 32 wall and thereafter the first panel 56 is placed in position covering the first compartment 32. The key lock 62 is manipulated to cause the latch 60 to be inserted into the catch 58, securing the first panel 56 to the cabinet 10.

In a similar fashion, a second panel 58 is provided and has a tongue 54 adapted to be received in a corresponding groove fashioned in the wall 20. The second panel 58 is thereafter moved into position to close the front of the second compartment 34 and a lock (not shown) is operated to lock the second panel to the partition wall 30. In this position, the second panel 58 is locked to the cabinet 10 closing the second compartment 54. As can be understood, the second panel 58 must be removed before the first panel 56 can be unlocked.

Figure 2:
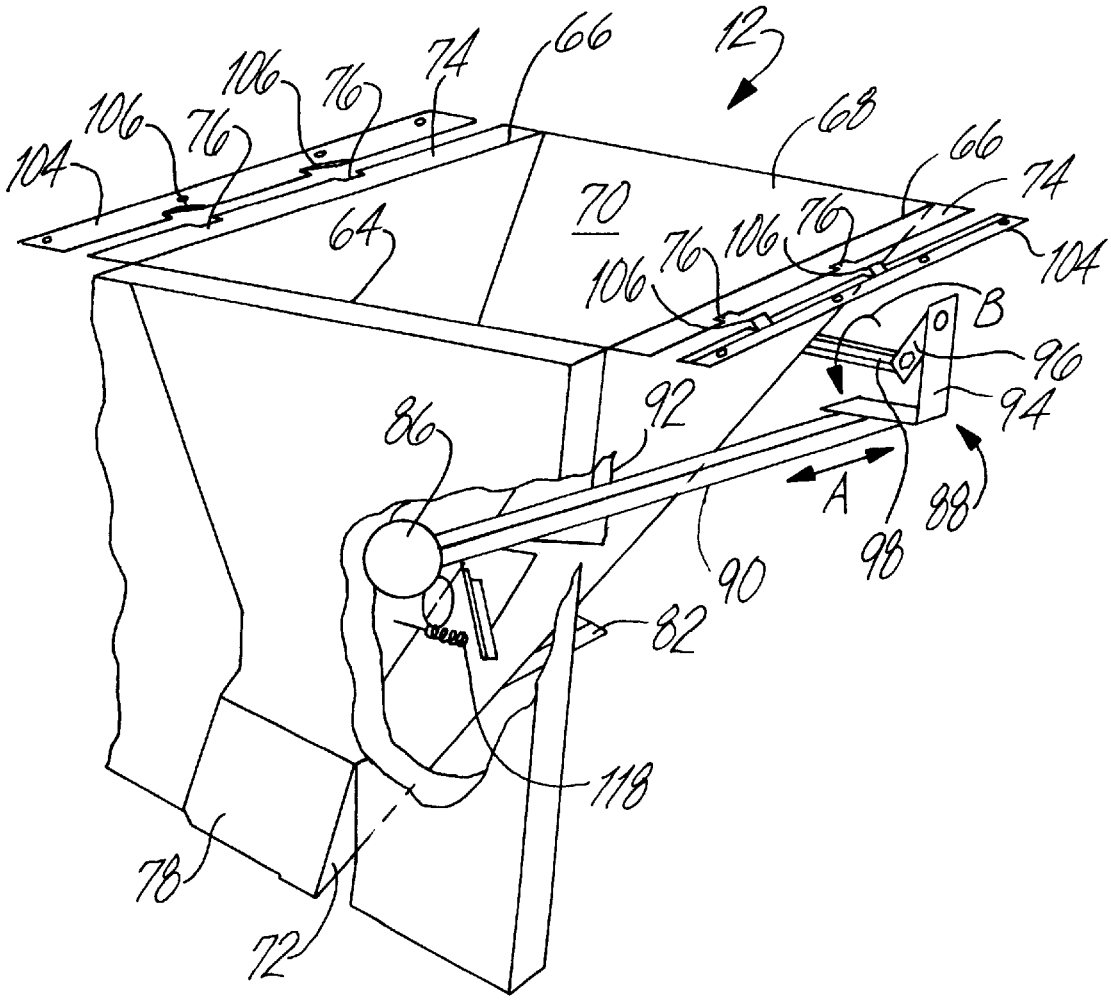
FIG. 2 is a front, right side perspective view of the hopper of the present invention.
Figure 3:
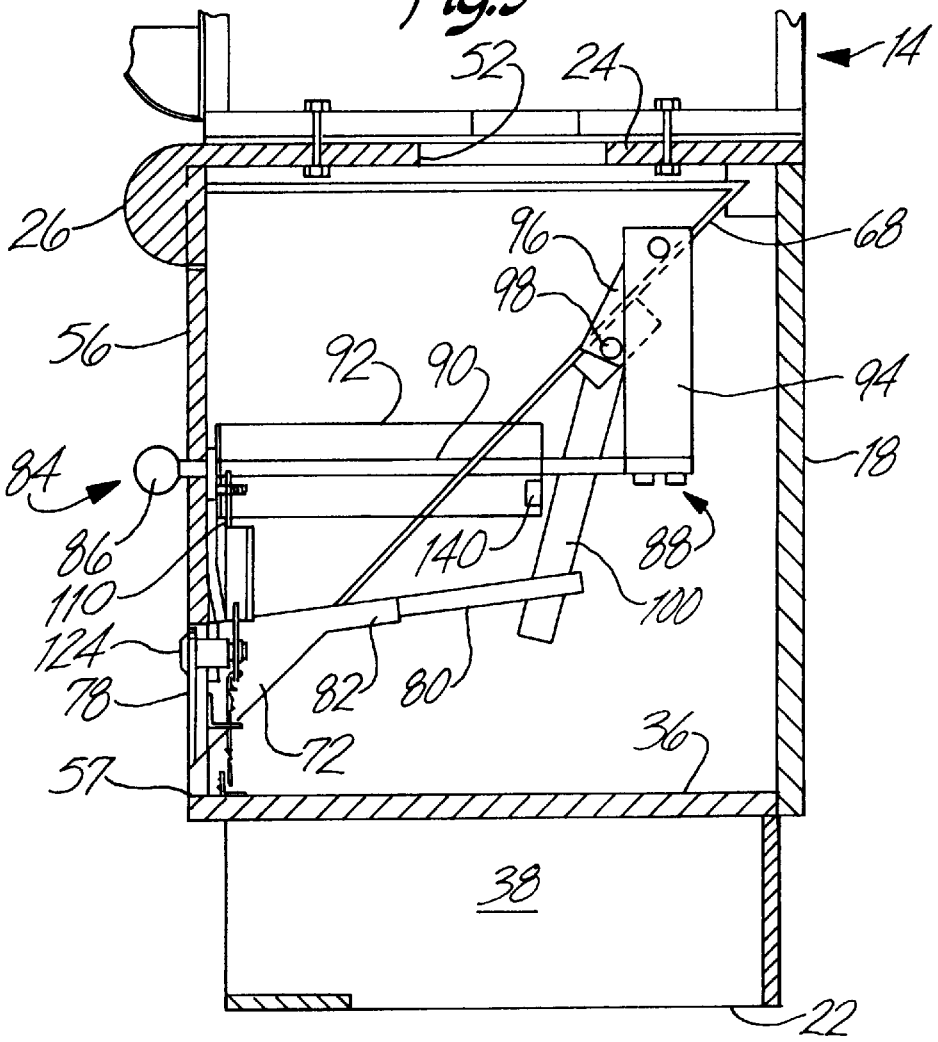
FIG. 3 is a side section view of the cabinet showing the hopper and the mechanism for operating the door thereof.

With reference to FIGS. 1 through 3, the hopper 12 according to the present invention is shown. Hopper 12 has a front wall 64, side walls 66 and a rear wall 68 which converged from an enlarged, open mouth 70 to a chute 72. The front, side and rear walls 64, 66, 68 are preferably fashioned from sheet metal as is the chute 72. Proximate the mouth 70, the hopper 12 has flanges 74 defined at the side wall 66. The flanges 74 project horizontally, when the hopper 12 is disposed in the cabinet 10, and include one but preferably a pair of slots 76 spaced therealong. At the opposite end, the hopper 12 terminates at a swinging cover 78 which is normally closed over the chute 72 but which pivots outwardly from the front wall 64 to permit coins or tokens to be discharged from the hopper 12 in a manner hereinafter described. When the hopper 12 is disposed in the cabinet 10 the chute 72 projects through the first panel 56 to discharge coins at the front 16 of the cabinet. Accordingly, the first panel 56 has an opening 57 for the chute 72.

To retain the coins or tokens within the hopper 12, the hopper 12 has a door 80 slidable between a closed and an open position. In the closed position, door 80 is disposed to block the chute 72 and prevent coins or tokens from being discharged therefrom. In the open position, the door 80 is withdrawn opening the chute 72 for the discharge of the coins therethrough and through the cover 78. Door 80 is preferably planar and is retained between a pair of tracks 82 defined at the sides 66 of the hopper 12 proximate its transition to the chute 72. In this position, the door 80 is slidable within the tracks 82 from a closed position closing the chute 72 to a withdrawn or open position opening the chute 72 for the discharge of coins or tokens.

To move the door 80 between the open and closed positions, the cabinet and hopper combination of the present invention includes an actuator to actuate the door preferably embodied as a handle 84 having at one end a knob 86 disposed at the front 16 of the cabinet 10 and at the other end coupled to a linkage 88 adapted to operate the door 80. As shown in FIG. 2, the handle 84 has a square shaft 90 which is adapted to pass through a hole 91 in the first panel 56 and to be coupled to the linkage 88. A brace 92 disposed at the side wall 66 of the hopper 12 supports the shaft 90 and handle 84 for longitudinal movement as suggested by arrow A of FIG. 2. Opposite the knob 86, the shaft 90 is coupled to an L-shaped first arm 94 which pivotally mounts at its end a second arm 96 which is, in turn, secured to a rod 98 rotatably disposed at the rear wall 68 of the hopper 12. As suggested in FIG. 2, pulling of the handle 84, pulls the first arm 94 toward the front wall 64 which in turn, through the second arm 96, urges the rod 98 to pivot as suggested by arrow B. With reference to FIG. 3, the rod 98 has disposed thereon a drive arm 100 which is received through a slot 102 fashioned in the door 80. Rotation of the rod 98 in the direction of arrow B displaces the drive arm 100 which, in turn, pulls the door 80 from a closed to an open position. Pushing the handle 84 rearwardly causes a reverse rotation of the rod 98 whereupon the drive arm 100 urges the door 80 to the closed position. Accordingly, an operator approaching the cabinet hopper combination according to the present invention need place a bucket or other container at the front of the cabinet 10 and pull the handle 84 to open the door 80 whereupon the coins or tokens retained within the hopper 12 are discharged through the chute 72 opening the cover 78 and dumping the coins or tokens into the bucket or container. The operator need not bend or stoop to pull a bucket from the cabinet 10.

To mount the hopper 12 within the cabinet 10, a pair of brackets 104 (FIG. 2) are retained at supports 50 as by screw fasteners or the like. Each of the brackets 104 includes a tab 106 adapted to be received through and register in each cooperative slot 76 when the hopper flanges 74 are properly aligned with the brackets 104. Preferably each bracket 104 has a Z-shaped cross-section defined by a flat to be secured to the supports 50 and a stepped-down flat. Accordingly, the user of the hopper 12 need only remove or open the first panel 56 and insert the hopper 12 into the first compartment 32 with the flanges 74 riding along the brackets 104 until the slots 76 are aligned with the tabs 104 whereupon the hopper 12 flanges 74 drop onto the flats and is aligned and retained in position on the brackets 104. The engagement of the tabs 106 in the slots 76 prevents forward and rear motion of the hopper within the first compartment 32. Downward motion is retained by engagement of the flanges 74 on the brackets 104 and upward movement is prevented by the weight of the hopper 12 itself.

Figure 4:
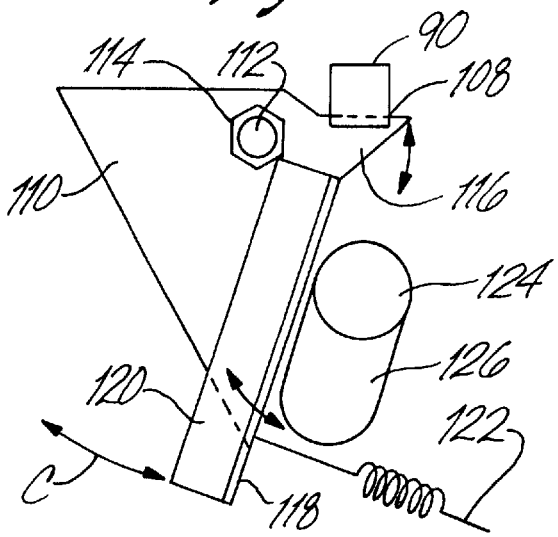
FIG. 4 is a rear view of one embodiment of the locking mechanism according to the present invention.

To lock the hopper 12 against unauthorized or inadvertent discharge of coins or tokens, means for locking the handle 84 are provided. With reference to FIG. 4, the shaft 90 of the handle 84 is shown engaged by the locking means. Accordingly, the shaft 90 includes a slot 108 defined along this length and adapted to be engaged by a locking plate 110 pivotally mounted to the inside of the first panel 56 or to the brace 92 by a bolt and nut 112, 114 for pivotal motion about the axis of the bolt 112. The plate 110 includes a tang 116 adapted to be received by the shaft slot 108 and a wing 118 which projects orthogonally from the plate 110 for the purposes of which will hereinafter become evident. Disposed proximate the wing 118 is a weight 120 which urges the plate 110 in a counter-clockwise direction as shown in FIG. 4 to maintain the tang 116 in engagement with the slot 108. To further urge the aforesaid engagement, a spring 122 may be connected between the wing 118 and hopper sidewall 66 to impose a counter-clockwise bias on the plate 110.

To displace the plate 110 such that the tang 116 disengages the slot 108, a lock 124 is provided on the first panel 56. The lock 124 is a key operated lock and includes a foot 126 coupled to the releasable cylinder of the lock 124. With reference to FIG. 4, the lock 124 is in a locked position with the foot 126 disposed such that the bias imposed by the weight 120 and/or the spring 122 urges the plate 110 such that the tang 116 is received in the shaft slot 108. When a key is inserted in a lock 124, the tumblers release the cylinder to rotate which rotates the foot 126 in the direction shown by arrow C to engage the wing 118 and to displace the plate 110 about the axis of bolt 112 so as to disengage the tang 116 from the shaft slot 108. In this position, the handle 84 is free to be pulled to operate the linkage 88 to move the door 80 from the closed to the open position to discharge coins or tokens from the hopper 12 into an awaiting bucket or container. After the coins or tokens have been discharged from the hopper 12 as fed by gravity, the handle 84 is pushed back into the first compartment 52 which operates the linkage 88 to return the door 80 to the closed position. The lock 124 is then rotated in reverse direction whereupon the bias imposed by the weight 124 and/or spring 122 urges the plate 110 to pivot to locate the tang 116 in the shaft slot 108 to prevent pushing or pulling of the handle 84 and the inadvertent or unauthorized discharge of coins or tokens from the hopper 12.

Figure 5:
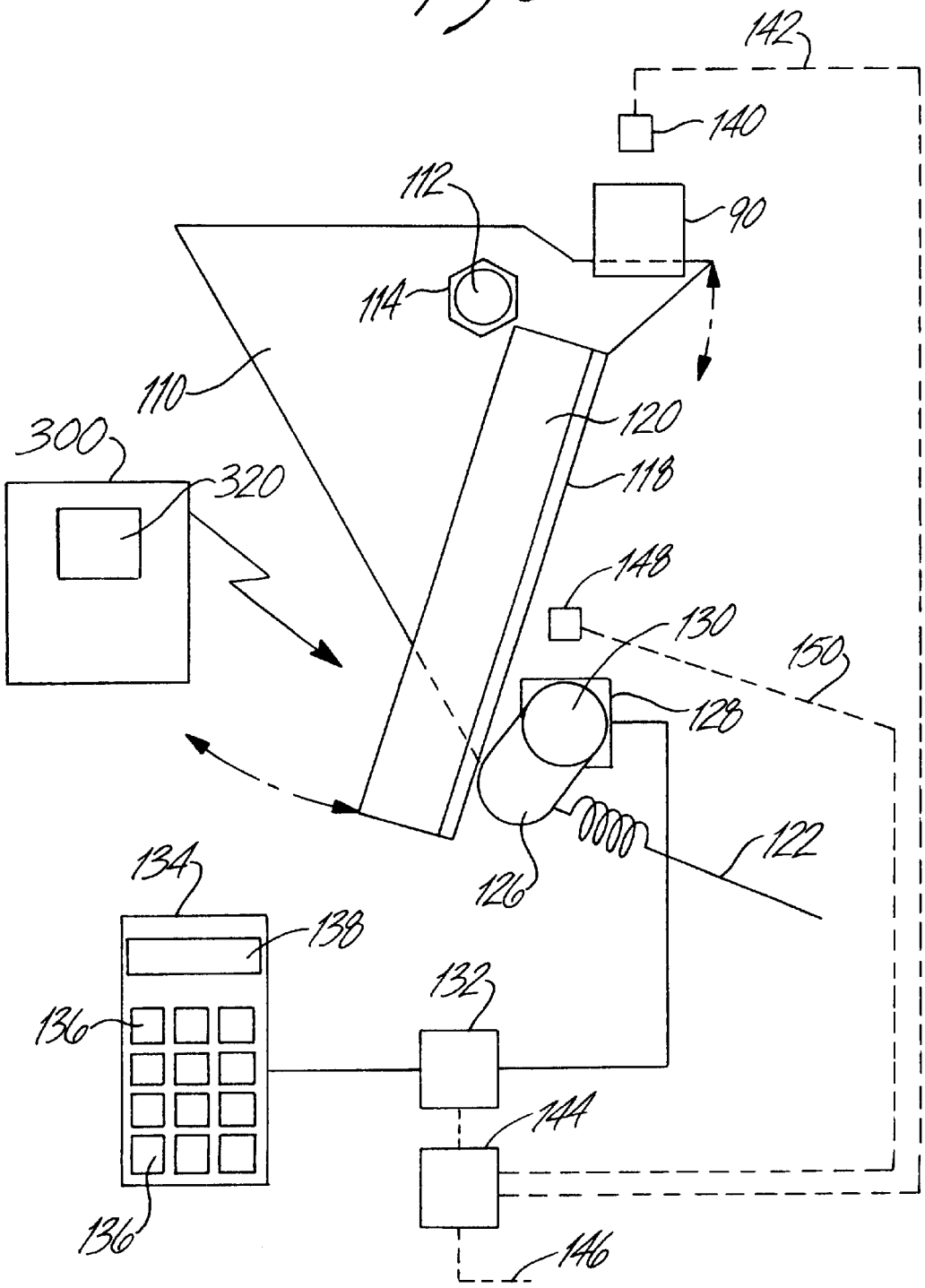
FIG. 5 is a rear view similar to that of FIG. 4 showing yet a further embodiment of the locking mechanism of the present invention.

With reference to FIG. 5, further locking means are shown. Like components bear the same reference numerals.

According to this embodiment, a stepper motor 128 is provided with a rotatable actuator 130 movable, in response to energizing the stepper motor 128, to rotate a foot 126 to displace the plate 110 in the manner described above. A controller 132 is provided to control the supply of power to the stepper motor 128, the controller accessed through a data entry device such as a keypad/card reader 134 disposed for example at a convenient location for a bank of slot machine cabinets 10. By the keys 136 on the keypad 134 and its display 138 or by swiping a card's magnetic strip containing coded data, personnel can input personal identification numbers and other codes to operate the controller 132 to, if the proper code is received, energize the stepper motor 128. Accordingly, personnel would input personal identification code into the keypad 134 which would operate the controller 132 to energize the stepper motor 128 to rotate the actuator 130 displacing the foot 126 engaging the wing 18 and pivoting the plate 110 to free the handle shaft 90 from the tang 116. In this position, the handle 84 may be pulled to operate the door 80 to discharge coins from the hopper 12. Once the coins have been discharged, the personnel inputs a proper security code into the keypad 134 which operates the controller 132 to reverse the stepper motor 128 and withdraw the foot 126 whereupon the plate 110 pivots in a reverse direction whereupon the tang 116 engages the shaft slot 108 to lock the shaft. It is to be understood that instead of inputting a code with the keypad 134, the card reader or other similar security device could be used to operate the controller 132 and thereby the stepper motor 128.

For example, the controller 132 may be embodied to include an electromagnetic (radio or infrared) signal receiver and the operator supplied with a portable transmitter 300. The transmitter 300, when the button 320 thereof is depressed, issues a coded signal to be received by the controller receiver. The controller includes a processor to compare the received signal to stored data to determine if the signal includes the proper, authorized, code to energize the stepper motor(s) 128 to unlock the handle shafts 90.

To monitor the operation of the hopper 12 according to the present invention, a first sensor 140 may be disposed to sense the lateral pulling or pushing of the handle shaft 90 in the manner suggested by FIG. 5. For example, when the shaft 90 is pulled to release coins, the first sensor 140 sends a signal 142 to a microprocessor 144 which, from the signal, generates data indicating displacement of the handle shaft 90, time of day and location. This data, by signal 146 is sent to a host processor to monitor the activity of the hopper 12. The host processor (not shown) would monitor the activity of a large number of hoppers 12 throughout the casino.

Additionally or alternatively, a second sensor 148 may be disposed to sense actuation of the stepper motor 128 and to generate a signal 150 in response thereto, that signal provided to the microprocessor 144. Again, the microprocessor 144, in response to the signal 150, generates data representative of the time, date, location of the signal as well as data which may identify the authorized individual operating the controller 132. This data, at data signal 146, is supplied to the host processor to monitor the operation of the hopper.

Accordingly, by the first and second sensors 140, 148, the operation of the hopper 12 and the emptying of coins or tokens therefrom can be remotely monitored and the data representative thereof archived in a suitable data structure.

Turning to FIGS. 6–9, a further aspect of the present invention is shown. Like components will bear like reference numbers.

Figure 6:
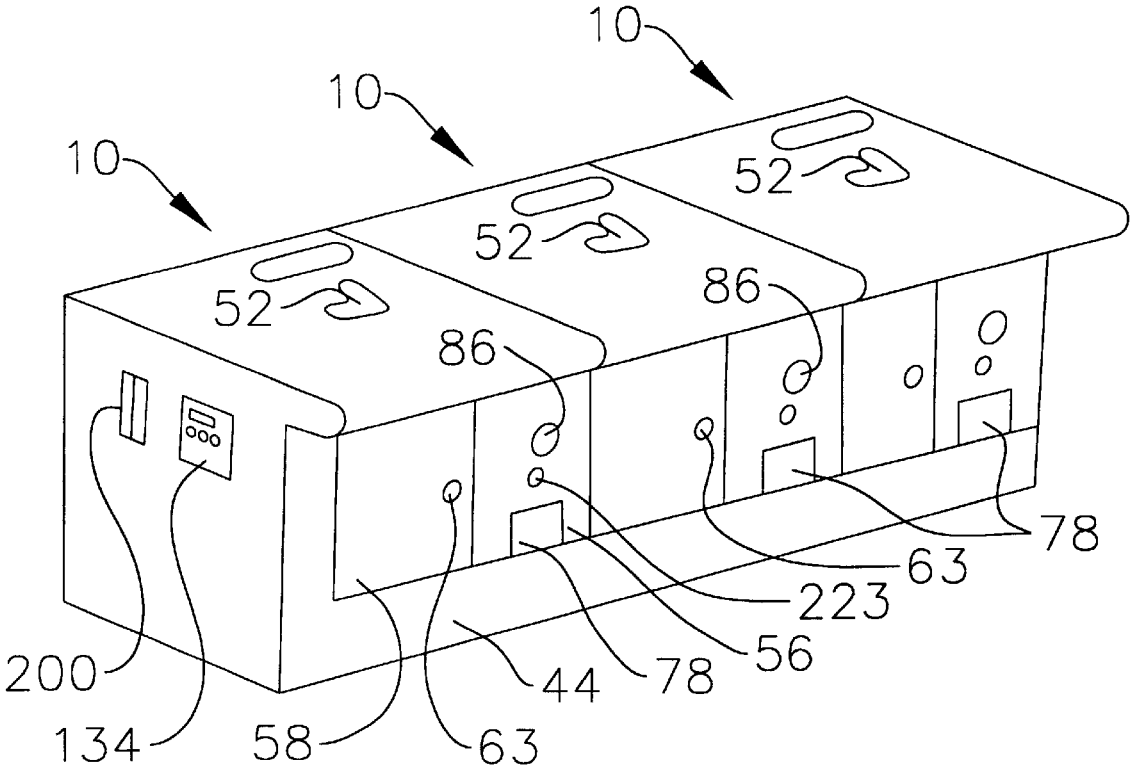
FIG. 6 is a top-front perspective view of a number of cabinets according to a further aspect of the present invention with the gaming machines removed for clarity.

With reference to FIG. 6, a plurality of cabinets 10 are shown placed together in an arrangement to support a bank of slot machines (not shown) thereon in a manner well known in the art. Each of the cabinets 10 as described above includes the first hole 52 to pass coins from the slot machines thereon into the first compartment 32 defined in the cabinet 10. Also, as shown, each cabinet 10 includes a cover 78, first and second panels 56,58, lock 124 to manually unlock the second panel 63 and the knob 86. While the arrangement shown in FIG. 6 includes three cabinets 10, it is to be understood that any number of cabinets 10 may be placed in any arrangement to support a bank of slot machines.

Disposed at a convenient location is a keypad 134 and, if desired, a card reader 200 of the type used to read magnetically encoded data on identification card.

To control the bank of cabinets 10 for discharging coins from their hoppers 12 contained therein (not shown in FIG. 6) means are provided for locking the handle 84 against movement thereby preventing the unauthorized actuation of the hopper door 80 for the discharge of coins from the hopper 12. These means include the plate 110, which may have a triangular shape, the plate 110 including a scalloped corner 202 adapted to, as described above, define the tang 116 adapted to engage into the slot 108 fashioned in the shaft 90 of the handle 84 to lock the handle 84 against movement to operate the linkage 88 for the operation of the hopper door 80. The plate 110 is pivotally mounted within the cabinet 10 by the bolt 112 and nut 114 (FIG. 7) to disengage the tang 116 from the slot 108 in the shaft 90 to free the handle 84 for lateral movement to operate the linkage 88 for opening and closing the hopper door 80.

To bias the plate 110 to a first, locked position wherein the tang 116 is located to engage into the slot 108, a weight 120 may be provided. Additionally or alternatively, an spring 122 may be coupled between the fixed platform of the cabinet 10 and the rotatable plate 110.

Figure 7:
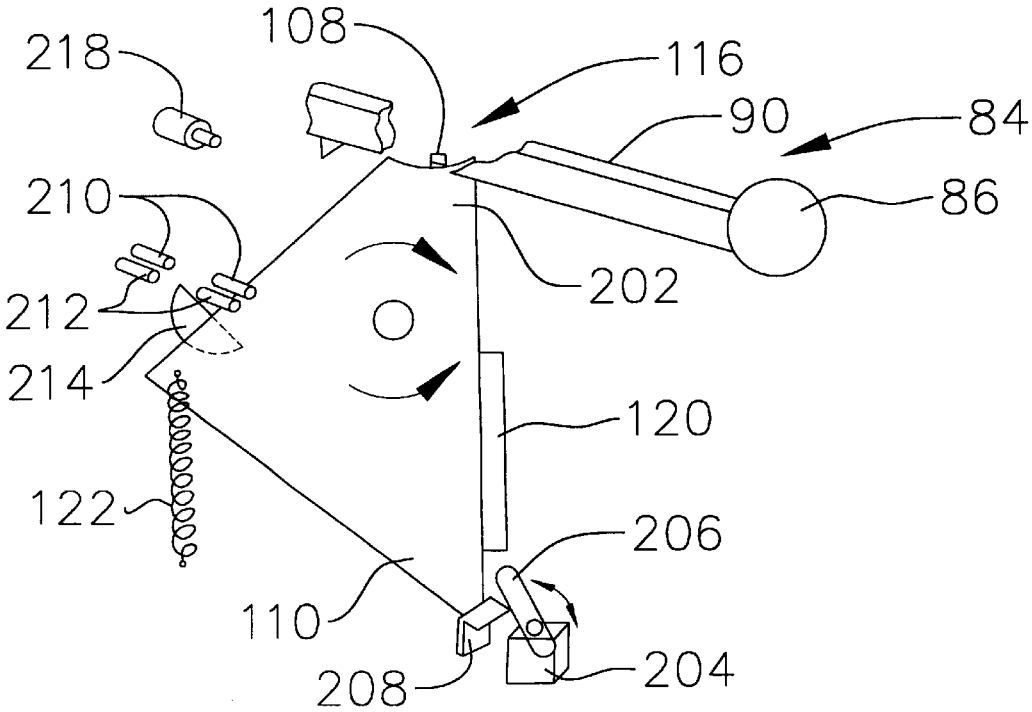
FIG. 7 is a front perspective view of a further embodiment of the locking means according to the present invention.

As described above, the plate 110 may be displaced manually by operation of the lock 24 (not shown in FIG. 7) which rotates the foot 126 against the plate 110 to displace the tang 116 from the slot 108 to free the handle 84. As shown in FIG. 7, to electronically free the handle 84 for opening of the hopper door 80, a servo 204 is provided which, when energized, rotates a bar 206 to engage and displace the plate 110 to move the tang 116 from the slot 108 to free the handle 84. The servo 204 may be of the type made by Cirrus, model CS-60 2BBMG. The bar 206, when the servo 204 is energized, engages an angled tab 208 fixed to the plate 110. Accordingly, it can be appreciated that when the servo 204 is energized, as described below, the shaft of the servo 204 rotates the bar 206 about an axis to engage the tab 208 and displace the plate 110 freeing the tang 116 from the slot 108. In this position, the handle 84 is unlocked and may be pulled to operate the linkage 88 to open the hopper door 80 to discharge coins through the cover 88 in the manner described above.

To sense the displacement of the plate 110, sensing means are provided and are illustrated in FIG. 7 as first and second optical sensors 210,212 spaced from each other. As is well known the first and second optical sensors 210,212 include a beam generator and receiver. When the beam between the generator and receiver is uninterrupted, a signal is also interrupted indicating that the beam has indeed been interrupted. When the beam is interrupted, the signal is terminated.

To cooperate with the first and second optical sensors 210,212, mounted on the plate is a sensor wheel 214 which is positioned to interrupt the beam of the first and second optical sensors as the plate 110 is rotated by actuation of the servo 204. The first optical sensor 210 is disposed such that its beam is not interrupted by the sensor wheel 214 when the plate 110 is in a locked position wherein the tang 116 is fully received into the slot 108 of the handle 84. Accordingly, if the tang 116 is not fully received into the handle slot 108, the first optical sensor 210 will be interrupted by the sensor wheel 214 signaling that the handle 84 is not completely locked. The second optical sensor 212 is positioned such that its beam is interrupted when the plate 110 is fully displaced to the unlocked position as driven by the servo 204. Accordingly, should the plate 110 not return from the unlocked position as by a malfunction of the servo 204, the second optical sensor 212 will be interrupted signaling such an event.

Continuing with FIG. 7, disposed on the handle 84 is a finger 216 adapted to, when the handle 84 is returned to the closed position to close the door 80, trigger a cherry switch 218 to turn off its light 223 disposed at the front of the cabinet 10 proximate the knob 86. Accordingly, by illuminating the light 223 when the handle 84 is not completely closed, security cameras can confirm that the handle 84 has not been returned to the fully closed position.

Figure 8:
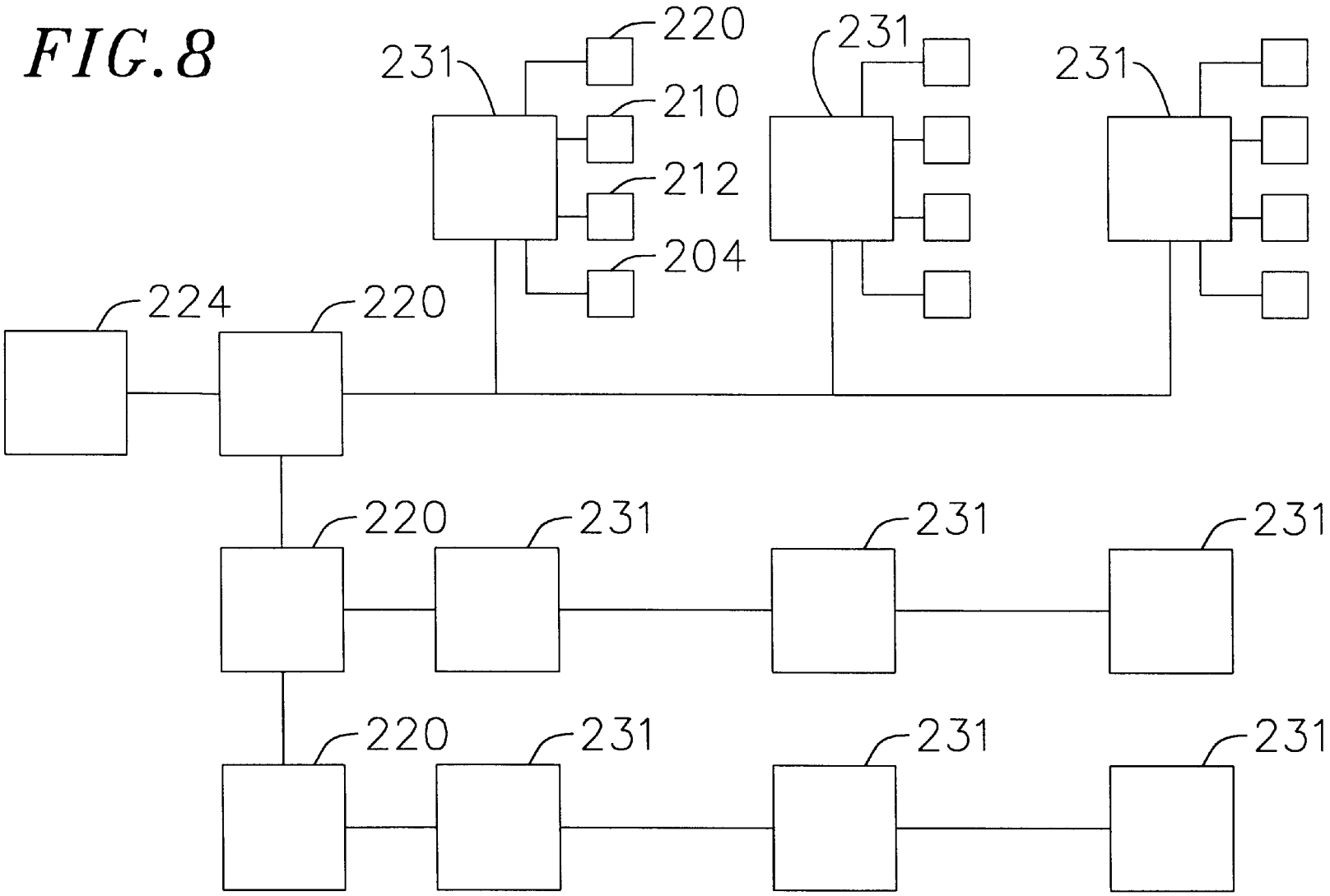
FIG. 8 is a diagram of the controller processor for the system and method.

Turning to FIG. 8, the operation of the servos 204 and first and second optical sensors 210,212 will now be described. Processors 220 are provided for each bank or group of cabinets 10, each processor in communication with its corresponding card reader 200 and keypad 134 which provide means to access and input data into the processor 220. As illustrated, the processors 220 may each be linked to a host processor 224 which monitors and controls any plurality of processors 220 disposed throughout the property as well as, for example, providing for player tracking, employee time and attendance and the like. Furthermore, the host processor 224 may provide a security feature to provide an overall indication as to the time and date when the hoppers 12 are being emptied.

Each of the processors 220 are in communication with each of a plurality of individual control units 231 for each hopper assembly. Each control unit 231 is, in turn, in communication with the light 220, sensors 210, 212 and servo 204 to control the operation thereof. Each control unit 231 may also serve as a link to provide data from each machine to the processors 220 and host processor 224 if desired. While only one string of control units 231 illustrating the communication with the servo 204, sensors 210, 212 and light 220 is shown, it is to be understood that the various banks of machines would be connected in a like manner.

When so instructed by the processor 220, the servos 204 for a bank of cabinets 10 would be energized by their control units 231 to release the handles 84 for opening of the hopper doors 80 to release coins from the hopper 12.

The transmitter 300 may also be used to send an authorized code to the processors 220 which, in response to an authorized code, issues signals to the control units 231 to operate the servos 204.

Figure 9:
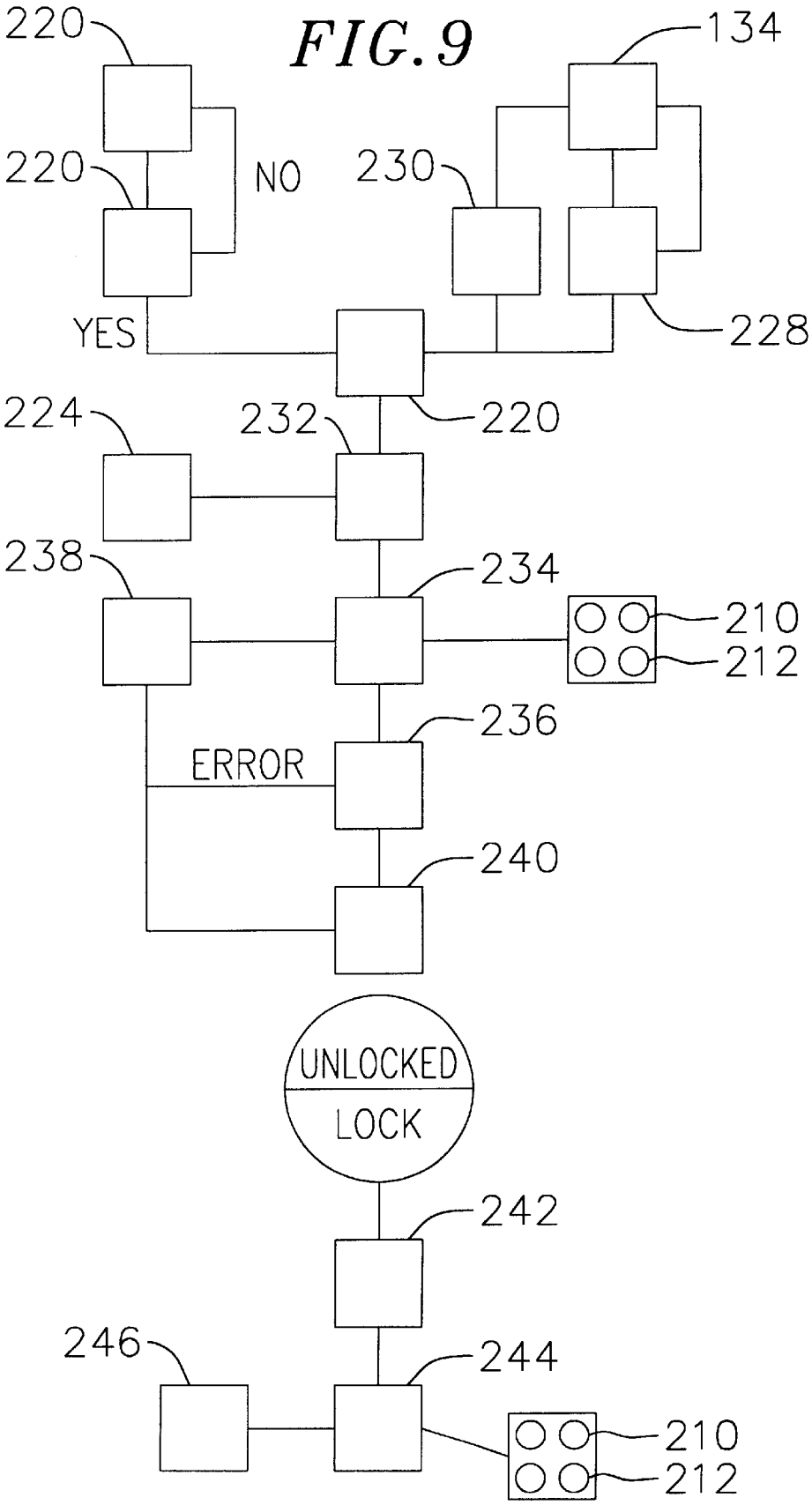
FIG. 9 is a logic diagram illustrating certain aspects of the present invention.

With reference to FIG. 9, the operation of the system and method of the present invention will now be described. At the card reader 200 the attendant swipes their identification card including magnetic or optically read data to gain access and to control the processor 220. Alternatively the attendant may input at the keypad 134 may input a security code or operate the transmitter 300 to input data into the processor(s) 220. At 226 the input data is compared by the processor 220 to security data stored in a suitable data structure to confirm that the card is acceptable to gain access to the processor 220. If it is acceptable, the processor 220 operates according to its programming. If not, the processor 220 does not operate and an error message is sent or a message is sent to re-enter the security data such as by re-swiping the card at the card reader 200. Additionally at the keypad 134 the attendant inputs an identifiable code such as the attendant's personal identification number or other information to confirm access to the processor 220. At 228 the input data is compared to data stored in a suitable data structure to confirm that the individual is entitled to gain access to the processor 220. At 230 a code may be entered to override the card reader 200 to enable the attendant to gain access to the processor 220 or to re-set data to control access to the processor 220. By using the keypad 134, the attendant inputs a code to unlock the handles 84 for the hoppers 12 to be emptied. Alternatively, each card or transmitter may transmit, along with the security code, data identifying the card or transmitter 300 and thereby the individual using the same. Upon that command the processor 220 issues a signal at 232 to the control units 231 to command the servos 204 for the hoppers 12 to be unlocked, the servos 204 in response to the command rotating their bar 206 against the plate 110 to displace the tang 116 from the slots 108 from the handles 84. The issuance of the signal to the servos 204 by the command shown at 232 may also result in the issuance of a signal to the host processor 224 to record the identity of the attendant issuing the command, date, time of day and the identity of the hoppers 12 being unlocked. In response to the command being issued at 232, the rotation of the plate 110 is monitored at 234 by receiving the signals from the first and second optical sensors 210,212. If the first optical sensor 210 does not issue a signal in response to the beam of light being blocked at 236 an error message is sent which may, for example, illuminate a light 238 at the keypad 134 or otherwise issue an error message. If the sensor wheel 214 does not interrupt the beam at the second optical sensor 212, at 240 an error signal is generated indicating that there has been a malfunction. If both of the first and second optical sensors 210,212 have been interrupted, the handle 84 is unlocked from the plate 110 and may be pulled to open the door 80 for the hopper 12 to dump the coins or tokens retained therein. The opening of the handle 84 illuminates the cherry switch light 223 giving a further indication that the door 80 is opened.

To lock the door 80, the processor 220 is prompted at 242 to send instructions to the control units 231 to command the servos 204 to rotate the bars 206 in a reverse direction whereupon the plate 110, under the bias of the spring 122 and/or weight 120, rotates in a reverse direction. The handle 84 is then pushed into the cabinet 10 until the tang 116 is received into the slot 108 locking the handle 84 into position. The processor 220 receives signals at 244 from the first and second optical sensors 210, 212 to confirm that the beams have now been re-established and that the sensor wheel 214 has moved to the locked position. If, for example, the first optical sensor 210 is interrupted by the sensor wheel 214, a signal is sent at 246 indicating that the handle 84 is still in the unlocked position. Once the handle 84 has been positioned such that the tang 116 is received into the slot 108, the beams of the first and second optical sensors 210,212 are uninterrupted signally a locked condition. Locking is confirmed by pulling on the handle 84 to check its movement and by turning off of the light 223 at the front of the cabinet 10.

While we have shown and described certain embodiments of the present invention, it is to be understood that it is subject to many modifications without departing from the spirit and scope of the appended claims.

What is claimed is:

1. A system for locking and unlocking an actuator for discharging coins from a hopper contained in a cabinet comprising:

a handle;

a linkage coupled between the handle and a door for the hopper, said linkage in response to movement of said handle between a first and second position opening and closing said door respectively, said hopper when said door is in the open position discharging coins;

means for locking the handle against movement from the the first to the second position, said locking means including, a plate pivotally mounted for rotation about an axis between a locked and an unlocked position, said plate in the locked position engaging said handle to prevent movement thereof, a driver member energized to displace said plate from said locked position to said unlocked position to free the handle for movement, and a controller for energizing said driver member.

2. The system of claim 1 further including means for sensing rotation of the plate and issuing a signal in response thereto.

3. The system of claim 1 further including means for sensing movement of the shaft.

4. The system of claim 1 further including a processor to control said controller and means for providing input into the processor to control said controller to energize said driver member.

5. The system of claim 4 including means for limiting input to said processor to authorized personnel.

6. The system of claim 5 wherein said limiting means includes a reader adapted to read data encoded on a card.

7. The system of claim 1 wherein the locking means includes an electrically driven unit having a member, and means for energizing the unit to displace the member to displace the plate.

8. The combination of claim 7 including a controller including a data structure including code data and means for inputting a code, said controller in response to input of a code corresponding to said code data energizing said unit.

9. The combination of claim 8 further including a host processor and means for communicating a signal from the controller to the processor in response to energizing said unit.

10. A system for locking and unlocking an actuator for discharging coins from one or more hoppers each contained in a cabinet comprising:

said actuator for each hopper including (i) a handle including a slot and (ii) a linkage coupled between the handle and a door for the hopper, said linkage in response to movement of said handle between a first and second position opening and closing said door respectively, said hopper when said door is in the open position discharging coins;

means for locking the handle against movement from the the first to the second position, said locking means including, a plate pivotally mounted for rotation about an axis between a locked and an unlocked position, said plate in the locked position inserted into said slot to prevent movement thereof, a servo energized to displace a member to engage and move said plate from said locked position to said unlocked position to free the handle for movement, a processor in communication with said servos for energizing of selected ones thereof, and means for limiting communication by said processor to authorized personnel.

11. The system of claim 10 including means for biasing said plate for insertion into said slot.

12. The system of claim 10 further including means for sensing the rotation of said plate and generating a signal in response thereto, said signals issued to said processor.

13. The system of claim 10 wherein the limiting means includes a data entry device in communication with said processor.

14. The system of claim 13 wherein said data entry device is a card reader adapted to read a code from a card, said processor including means for comparing the read code to an authorized code and if the read code corresponds to the authorized code energizing selected servos.

15. The system of claim 13 wherein said data entry device is a keypad.

16. The system of claim 13 wherein said data entry device is a transmitter adapted to transmit a coded electromagnetic signal, the system further including a receiver to receive said signal in communication with said processor, said processor including means for determining if the received signal includes an authorized code to control the processor to energize said servos.

* * * * *